United States Patent [19]

Baker et al.

[11] Patent Number: 5,067,305

[45] Date of Patent: Nov. 26, 1991

[54] SYSTEM AND METHOD FOR CONTROLLING AN APPARATUS TO PRODUCE MAIL PIECES IN NON-STANDARD CONFIGURATIONS

[76] Inventors: Walter J. Baker, 378 N. Abram St., Stratford, Conn. 06497; Christopher S. Riello, 2838 Whitney Ave. #14, Hamden, Conn. 06518

[21] Appl. No.: 491,871

[22] Filed: Mar. 12, 1990

[51] Int. Cl.[5] ..... B65B 57/16; B65B 61/02

[52] U.S. Cl. ..... 53/411; 53/460; 53/54; 53/55; 53/117; 53/131.4; 53/284.3; 53/501; 493/16; 493/28

[58] Field of Search ..... 53/54, 55, 206, 266 A, 53/117, 131, 411, 460, 429, 501, 131.4, 131.5, 284.3; 270/1.1, 54; 493/12, 16, 28

[56] References Cited

U.S. PATENT DOCUMENTS

| | | | |
|---|---|---|---|
| 3,265,382 | 7/1966 | Sherman | 270/45 |
| 3,336,726 | 8/1967 | Mayer | 53/117 |
| 3,382,778 | 5/1968 | Berkowitz | 93/61 |
| 3,457,696 | 7/1969 | Berkley | 53/31 |
| 3,510,122 | 5/1970 | Gavaghan | 270/68 |
| 3,820,447 | 6/1974 | Gendron et al. | 93/23 |
| 3,897,720 | 7/1975 | Hiersteiner | 93/61 |
| 3,901,797 | 8/1975 | Storace | 209/900 |
| 4,014,535 | 3/1977 | Kleid et al. | 270/19 |
| 4,022,457 | 5/1977 | Marin et al. | 270/86 |
| 4,067,171 | 1/1978 | Herbert et al. | 156/384 |
| 4,101,121 | 7/1978 | Rustorguyelf | 270/68 A |
| 4,121,818 | 10/1978 | Riley | 270/54 |
| 4,299,073 | 11/1981 | Goucz | 53/206 X |
| 4,312,169 | 1/1982 | Golicz et al. | 53/206 |
| 4,543,082 | 9/1985 | Stenner | 493/216 |
| 4,571,925 | 2/1986 | Adams | 53/54 X |
| 4,694,632 | 9/1987 | Gunther, Jr. | 53/55 |
| 4,694,691 | 3/1987 | Buckholz | 53/54 X |
| 4,701,155 | 10/1987 | Ott | 493/11 |
| 4,701,233 | 10/1987 | Beck et al. | 156/217 |
| 4,731,048 | 3/1988 | Marrella et al. | 493/188 |
| 4,731,741 | 3/1988 | Allen | 364/518 |
| 4,733,856 | 3/1988 | Gunther, Jr. | 270/1.1 |
| 4,800,506 | 1/1989 | Axelrod et al. | 364/478 |

*Primary Examiner*—John Sipos

*Attorney, Agent, or Firm*—Robert H. Whisker; Melvin J. Scolnick; David E. Pitchenik

[57] ABSTRACT

An apparatus and control system for producing items in selected configurations and a system and method for controlling the same. More particularly, an apparatus for producing mail pieces and a system and method for controlling it to produce mail pieces in a variety of configurations are disclosed. The apparatus includes a laser printer and folding sealing apparatus controlled by a data processor. The folder sealer apparatus combines sheets printed by the laser printer with pre-printed sheets and envelope forms, which also may be printed by the laser printer or may be windowed envelopes, folds the sheets as necessary and folds and seals the envelope form about the folded sheets to produce a mail piece. A user inputs a configuration for the mail piece which is translated by the data processor into a data structure and transmitted to the controller of the folder sealer apparatus. The controller controls devices comprised in the laser printer and the folder sealer by executing state routines in accordance with the data structure to produce the mail piece in the defined configuration. Concurrently the data processor transmits text from an output file to the laser printer for printing on printed sheets and envelope forms. The data processor also controls the laser printer to print an address for the mail piece either on an envelope form or on a printed sheet in a position where it will be visible through the envelope. Thus, the apparatus is controlled to process an output file stored in the data processor into a mail run having a selected configuration. A system for processing mail pieces having a non-standard configurations is also disclosed.

5 Claims, 9 Drawing Sheets

SYSTEM AND METHOD FOR CONTROLLING AN APPARATUS TO PRODUCE MAIL PIECES IN NON-STANDARD CONFIGURATIONS

RELATED APPLICATIONS

The subject application is one of the following group of commonly assigned patent applications, all filed on even date herewith, all of which relate to a particular development effort conducted for the assignee of the subject application and which share common elements of disclosure.

| | | |
|---|---|---|
| Ser. No. 492,043 | Envelope Form For Preparing a Multi-Sheet Mail Piece | (C-624) |
| Ser. No. 491,871 | System and Method for Controlling an Apparatus to Produce Mail Pieces in Non-Standard Configurations | (C-625) |
| Ser. No. 492,039 | System and Method for Controlling an Apparatus to Produce Mail Pieces in Selected Configurations | (C-626) |
| Ser. No. 493,016 | System and Method for Producing Items in Selected Configurations | (C-631) |
| Ser. No. 491,881 | Mechanism and Method for Accumulating and Folding Sheets | (C-632) |
| Ser. No. 491,875 | Flap Opening Mechanism and Method | (C-633) |
| Ser. No. 491,886 | Mechanism and Method for Folding Folding and Sealing the Upper and Side Flaps of an Envelope Form | (C-634) |
| Ser. No. 491,887 | Mechanism and Method for Laterally Aligning an Accumulation of Sheets | (C-635) |
| Ser. No. 492,035 | Sheet Feeder | (C-636) |

BACKGROUND OF THE INVENTION

This invention relates to apparatus for producing mail pieces in a variety of configurations. More particularly, it relates to a control system and method for an apparatus and process which may produce mail pieces in a selected one of a plurality of possible configurations and which has a capability for handling non-standard configurations.

Self-mailers are mail pieces which are produced from pre-cut forms which are folded and sealed to form a mail piece, and are well known, as is apparatus for printing and forming such self-mailers. Commonly assigned, co-pending U.S. application, Ser. No. 407,583, to: Samuel W. Martin, filed Sept. 14, 1989 discloses one such self-mailer wherein a pre-cut form is printed on a laser printer, or similar computer output printer, and fed to a folding and sealing apparatus to produce a self-mailer. Similarly, U.S. Pat. No. 3,995,808 to: Kehoe, issued Sept. 7, 1976 discloses another self-mailer wherein a web of forms is printed, folded longitudinally and sealed, and separated to form individual self-mailers. U.S. Pat. No. 4,063,398 to: Huffman, issued: Dec. 20, 1977 discloses another self-mailer wherein a web of forms is folded transversely to produce self-mailers. Huffman also provides for insertion of preprinted piece or "stuffers".

In general self-mailers as taught by the prior art are useful as a means of generating large numbers of mail pieces, but are limited in that they can be formed into only a small number of configurations. (By configurations, as applied to mail pieces herein, is meant variations such as use of a windowed or a printed envelope, variations in the number and type of printed pages, and variations in the number and type of pre-printed inserts.) At most, like Huffman they may provide for an ability to insert "stuffers". Further, with the exception of the above mentioned U.S. application, Ser. No. 407,583 the equipment for producing such self-mailers has generally been physically large and suitable only for use in environments such as large computing centers.

Where it has been necessary to provide greater flexibility in the configuration of a mail piece which may be produced the solutions taught by the prior art have generally involved the use of inserters. An inserter is a transport system having a plurality of stations and along which a "control document" is transported from station to station. At selected stations pre-printed inserts maybe accumulated with the control document and at the last station the entire accumulation is inserted in a preformed envelope. A typical use of such inserter systems would be by a bank mailing monthly statements to its customers, where the control document would be individual statements printed on the bank mainframe computer and the inserts would include each individual's cancelled checks. Such inserter systems are described, for example, in U.S. Pat. No. 3,935,429; to: Branecky et al.; For: Process and Apparatus for Controlling Document Feeding Machines From Indicia Contained on a Document Fed Therefrom; issued Jan. 27, 1976.

Inserters do provide a high degree of flexibility in producing mail pieces in a number of configurations, and have proven very satisfactory for users such as banks and credit card companies. However, they suffer also from major limitations. First, because inserter systems generally do not operate under the control of the computer which prints the control document, a very significant problem exists in assuring that the proper inserts are matched with the correct control document. Because of this difficulty it has generally been necessary to use window envelopes with inserter systems rather than printed envelopes, so that an address pre-printed on the control document could be used to deliver the mail piece. Finally, inserters, like equipment for producing self-mailers, are generally quite physically large and suitable for use only in a large computer operation or production mail room.

Another approach to the problem of producing mail pieces was developed by Pitney Bowes Inc., assignee of the subject invention, under contract with the U.S.P.S. This equipment, known as PPHE (for Printing and Paper Handling Equipment) This equipment printed a continuous web, collated and separated the web to form sheets, folded the collated sheets longitudinally, and wrapped an envelope form around the wrapped sheets. The PPHE had a capability to add "stuffers" to a mail piece; and was intended for production applications only, as the equipment was tens of feet long. The PPHE lacked capability to print envelope forms or handle multiple sheets.

Thus, it is an object of the subject invention to provide a control system and method suitable for controlling an apparatus for producing a mail piece in a selected one of a plurality of possible configurations, and which is capable of handling non-standard configurations.

It is another object of the subject invention to provide such a system and method which are suitable for use with a personal computer.

BRIEF SUMMARY OF THE INVENTION

The above objects are achieved and the disadvantages of the prior art are overcome in accordance with the subject invention by means of an apparatus which includes an input for input of information defining a mail piece configuration and sheet processing apparatus for accumulating sheets with an envelope form, folding the accumulated sheets and envelope form, and then sealing the envelope form to form the mail piece; where the folder sealer apparatus has a capacity to fold a predetermined maximum number of sheets. The apparatus of the subject invention also includes a control system for determining the number of sheets in the mail piece in accordance with the defining information and, if the number of sheets is less than the maximum, controlling the folder sealer apparatus in accordance with the defining information to form the mail piece in the configuration, and, if the number of sheets is greater than the maximum, aborting operation of the folder sealer apparatus without forming the mail piece.

In accordance with one aspect of the subject invention the sheet processing apparatus includes a printer for printing text on at least some of the sheets, and the control system aborts operation of the sheet processing apparatus by diverting those sheets to output after printing of the text and before accumulation, folding and sealing.

In accordance with still another aspect of the subject invention the sheet processing apparatus responds to the control apparatus for performing a sequence of operations to form the mail piece, and the control system translates the defining information into a data structure including a plurality of data elements, each data elements specifying control parameters for an operation in the sequence, and one of the data elements further includes a control parameter for causing the control system to execute a predetermine routine to determine the number of sheets in the mail piece configuration, and to abort or continue processing accordingly.

Thus it may be seen that apparatus in accordance with the subject invention advantageously achieves the above objects and overcomes the disadvantages of the prior art. Other objects and advantageous of the subject invention will be apparent to those skilled in the art from consideration of the detailed description set forth below, and of the attached drawings.

DETAILED DESCRIPTION OF PREFERRED EMBODIMENTS OF THE SUBJECT INVENTION

Figure 1:
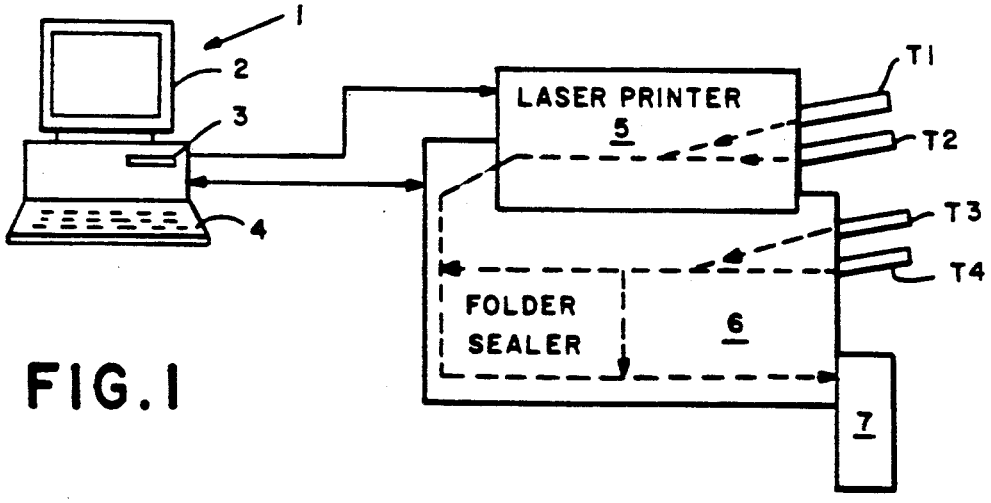
FIG. 1 shows a schematic block diagram of apparatus in accordance with the subject invention.

FIG. 1 shows a system with which the subject invention may be used. The system includes a personal computer 1 including a monitor 2, a hard disk 3 with one megabyte of available storage, and a keyboard 4. Computer 1 also requires a minimum of 640K of RAM memory in the subject invention. Optionally a computer "mouse" (not shown) may be provided for operator input. Computer 1 communicates with laser printer 5 through a conventional parallel interface which is preferably the well known Centronix interface. Preferably, Laser printer 5 is a commercially available Laser printer such as those marketed by the Hewlett Packard Corporation under the trademark "Laser Jet". Other printers, including ink jet and impact printers, may also may be used in the subject invention.

Laser printer 5 includes trays T1 and T2 from which sheets are fed to laser printer 5 for printing, as will be described further below. Tray T1 may be used for envelope forms, and tray T2 may be used for either three-thirds sheets or two-thirds sheets.

Laser printer 5 is mounted on, and physically connected to, folder sealer 6 so that, after printing, sheets are passed from laser printer 5 to folder sealer 6 where they are accumulated with an envelope form, folded and sealed, and output to stacker 7. Folder sealer 6 also includes trays T3 and T4 which may be used to add pre-printed sheets to the mail piece. Tray T3 and tray T4 may be used to supply either three-thirds, two-thirds, or one-thirds length pre-printed sheets or pre-printed business reply envelopes (BRE's) to be added to the mail pieces. Tray T3 may also be used to provide a window envelope form so that the address of the mail piece may be printed on a printed sheet rather than a separate (non-window) envelope form.

Those skilled in the art will readily appreciate that the system shown in FIG. 1 provides an almost limitless ability to produce mail pieces having a selected configuration. In a preferred embodiment of the subject invention the allowable combinations are limited by the following rules:

1. Each feeder tray: T1, T2, T3, T4 will have homogenous stock.
2. Each mail piece will include exactly one envelope.
3. Each mail piece will include a least one non-envelope.
4. Each mail piece having a window envelope, will include at least one printed sheet.
5. For each mail piece a feeder will supply no more than two one-third sized sheets.
6. Each mail piece will include no more than one BRE.
7. Because of the practical limitations on folding ability each mail piece will include no more than a total of three two-thirds size or three three-thirds size sheets.
8. Because of the practical limitations on envelope thickness each mail piece will be nor more than twelve sheets thick, where BRE's are considered to be two sheets thick.

Those skilled in the art will recognized that the above rules are basically matters of practicality and common sense and form no part of the subject invention per se. For example, a mail piece comprising a window envelope and no printed sheet would not have an address and should not be permitted. Practical limitations such as those on folding thickness or envelope thickness may be overcome by design changes without departing from the spirit of the subject invention.

Even though limits, such as that on folding ability, of the subject invention may be increased over those of the preferred embodiment through further development, nonetheless it will always be the case that practical limits will exist. Thus it will always be possible that a mail piece configuration may be specified which will exceed those limits. In such a case it would, of course, be possible for the system to abort production of such mail pieces, or even of the entire mail run. This however would result in an error condition which would require intervention, and which might be difficult for a low level user to correct.

This problem is overcome in the subject invention by testing each mail piece as associated printed sheets are being printed. When the mail piece exceeds the limit on folding capability, the printed sheets, which may include an envelope form, are printed normally but are diverted from folder sealer 6; as will be described more fully below. Thus all printed information is saved while a jam is avoided. Once the mail run is completed it will be a simple matter to manually combine the diverted printed sheets with any pre-printed sheets and any window envelope form to produce the mail piece or pieces needed to complete the mail run.

Figure 2:
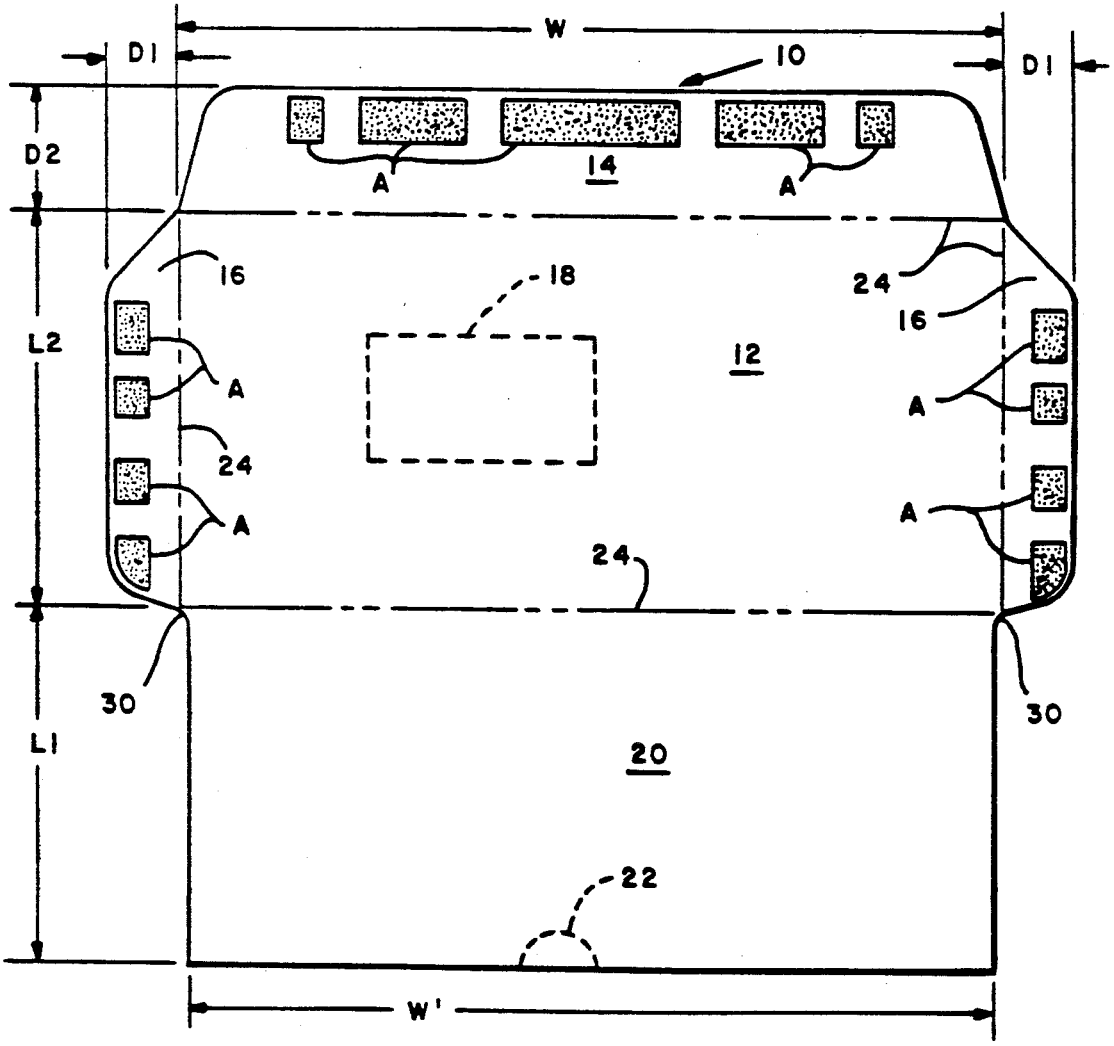
FIG. 2 shows a plan view of an envelope form suitable for use with the apparatus of FIG. 1.

FIG. 2 shows a unique envelope form, which is designed to function optimally with the apparatus the subject invention. Form 10 includes an upper panel 12 having an upper (or trailing) flap 14 and a pair of side flaps 16. Panel 12 may also be provided with a window 18 so that the mail piece formed when form 10 is folded and sealed may be delivered to an address printed on a sheet in the mail piece. An adhesive A is applied to flaps 14 and 16 to provide for sealing of form 10 to form an envelope. Preferably adhesive A is applied to flaps 14 and as spaced stripes or spots so that form 10 may be driven through the apparatus of FIG. 1 by segmented rollers contacting form 10 in the spaces between the stripes or spots of adhesive A to prevent contamination of the rollers when adhesive A is moistened prior to sealing and, also, to reduce curling of the form. Adhesive A is preferably a remoistenable adhesive which is moistened for sealing as will be described further below, but the use of self-adhesive or other suitable methods of sealing is within the contemplation of the subject invention. Flaps 14 and 16 are attached to upper portion 12, as is a rectangular lower portion 20, along preformed fold lines 24, which are preferably pre-creased to facilitate uniform folding.

To form a mail piece, sheets, which may be three thirds, two-thirds, or one-thirds sheets or BRE's, are accumulated with form 10, and form 10, together with the accumulated sheets, is folded about a preformed fold line 24 so that the accumulated sheets are enclosed between panels 12 and 20. Adhesive A is moistened, and after folding of panels 12 and 20 and the accumulated sheets, flaps 16 are folded inwards about fold lines 24 and flap 14 is than folded downwards about preformed fold lines 24, and the resulting mail piece is sealed.

Note that three-third length sheets are prefolded to two-thirds length so that the resulting mail piece is approximately one-third the length of a three-thirds sheet.

Form 10 also may be provided with expansion fold lines parallel to and outboard of lines 24 to allow for mail pieces having a maximum thickness and lower panel 20 may be provided with a notch 22 to facilitate removal of the sheets when the mail piece is opened.

For a standard $8\frac{1}{2}\times 11$ size three-thirds sheet the following approximate dimensions have been found to be satisfactory for form 10.

Figure 3:
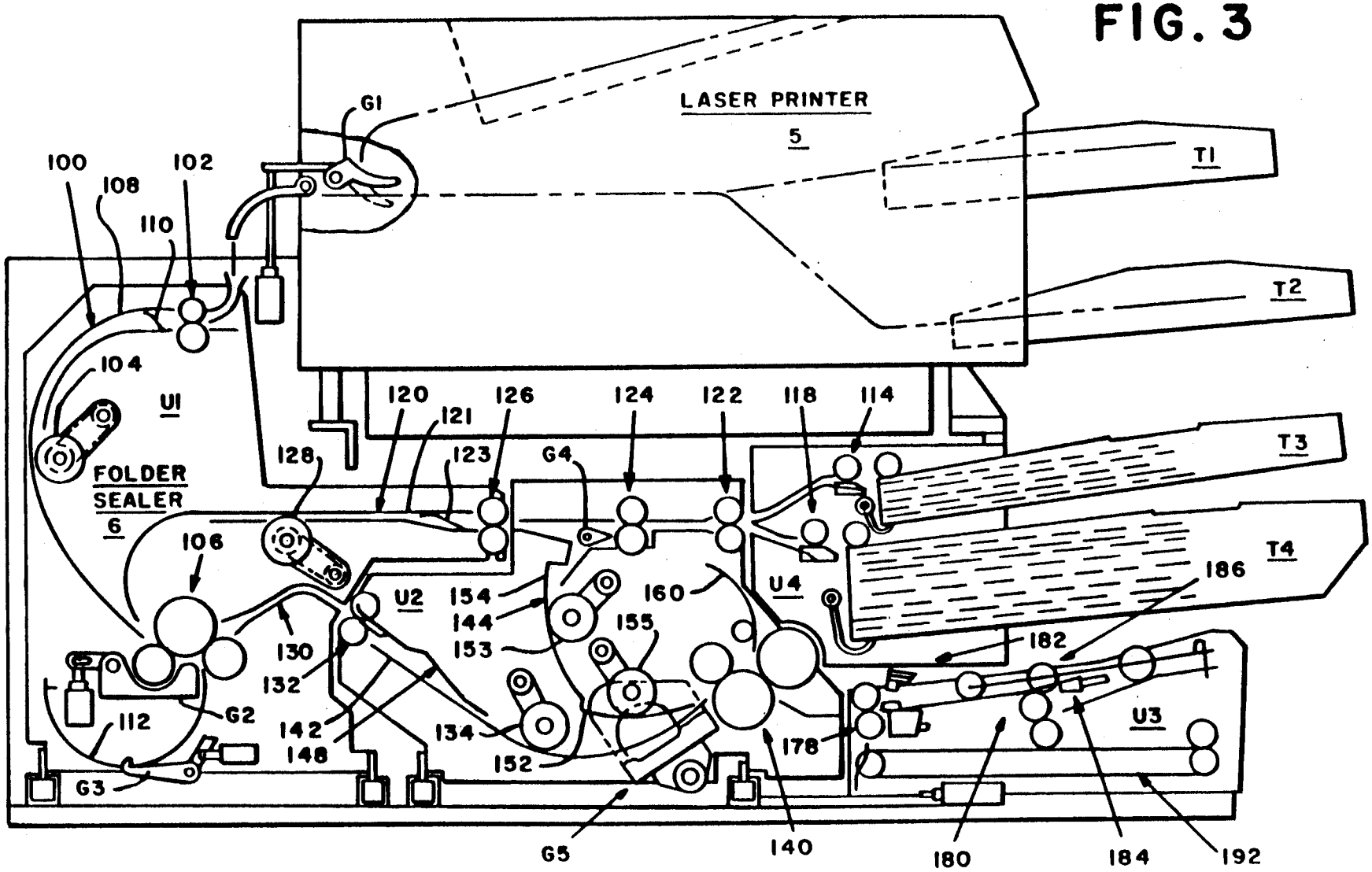
FIG. 3 shows a semi-schematic side view of a printer and a folder sealer apparatus in accordance with the subject invention.

D1=0.75 inches
D2=1.31 inches
L1=3.75 inches
L2=4.13 inches
W=8.70 inches
W'=8.50 inches Turning now to FIG. 3 a schematic side view of folder sealer 6 is shown. As a printed envelope form 10 or a printed sheet exit laser printer 5 it is driven along guides 100 by roller pair 102 and then urged into the nip of accumulator folder assembly 106 by urge roller 104. (As used herein a sheet is "urged" when it is moved by a "urge roller" constructed to slip (or stall) on the sheet before it will buckle under the load. This contracts with sheets which are driven by a roller pair in a positive manner substantially without slipping.) Normally the first item will be an envelope form 10 and gate G2 will be in the activated (closed) state diverting form 10 for further processing as will be described further below. Normally following items will be printed sheets and motor M1 (shown in FIG. 6), which drives folder accumulator assembly 106 will be stopped and the sheet will be urged into the nip of assembly 106 by urge roller 104, which will continue to rotate. Because guide 100 is curved to increase the stiffness of the sheets roller 104 will slip on the sheets as they are urged into the nip of assembly 106 before the sheets will buckle. Relief 108 and spring 110 are provided in guide 100 so that the tail of any three-thirds sheet is held clear of roller pair 102 so that following printed sheets may pass over the first sheet and be accumulated in the nip of assembly 106.

If the sheets accumulated in the nip of assembly 106 include a three-thirds sheet, gate G2 is deactivated (open) and motor 1 is started and the accumulated sheets are driven into curved, open, one-sided buckled chute 112. The assembled sheets are folded by assembly 106 to a two-thirds length and exit assembly 106 for further accumulation with the previously passed form 10. Gate G3 may be activated for a "Z" fold (normally used with a window envelope).

If the sheets to be folded have significant curl it may prove necessary or desirable to use conventional closed buckle chutes or to provide some other means of controlling the folding of curled sheets predisposed to fold in the wrong direction.

Alternatively a window envelope or pre-printed sheets, of three-thirds length, may be fed from trays T3 or T4 by feeder assemblies 114 or 118 and, with gate G4 deactivated, driven along curved guides 120 by roller pairs 122, 124, and 126 and then urged by urge roller 128 for processing by accumulator folder assembly 106 in the same matter as described above for printed envelope forms 10 and printed sheets. Relief 121 and spring 123 are provided to assure that following sheets pass over previous sheets for accumulation.

If the sheets accumulated in the nip of assembly 106 are all two-thirds length the assembled sheets exit assembly 106 along guide 130 without folding.

The previously processed form 10, followed by the assembled sheets, is moved along guides 130 by roller pair 132 and urge roller 134 until it is urged into the nip of accumulator folder assembly 140. Motor M2 (shown in FIG. 6), which drives assembly 140 is off and the leading edge of the accumulated sheets is aligned with the edge of lower panel 20 of form 10 in the nip of assembly 140. In the same manner as previously described guides 130 are curved to increase the stiffness of form 10 and the accumulated sheets. Relief 142 operates as described above so that the accumulated sheets will clear form 10 and progress to the nip of assembly 140.

Since laser printer 5 will normally have a fed path whose width is limited to conventional paper size (e.g. approximately 8½") envelope form 10, when fed through printer 5 is fed with flaps 16 folded into the closed position. Accordingly, an opening mechanism 148 is provided along path 130 to open flaps 16 before form 10 is accumulated with the following sheets.

Because form 10, with flaps 16 opened, is substantially wider than the sheets a centering mechanism, G5, is provided to assure that the sheets are centered with form 10. Opening mechanism 148 and centering mechanism G5 will be described more fully below.

If two-thirds sheets, one-third sheets, or BRE's are fed from trays T3 or T4 along guides 120 gate G4 is activated and these sheets are diverted to guides 144. The diverted sheets are urged by urge rollers 146 and 148 into the nip of assembly 140 and are accumulated in the manner described above in the nip of assembly 140 with the previously processed envelope form 10, any printed sheets, and any pre-printed three-thirds sheets. Guides 144 include relief 152 for three-thirds pre-printed sheets and BRE's and relief 154 for two-thirds pre-printed sheets.

After all sheets are accumulated with form 10 motor M2, which drives accumulator folder assembly 140, is started and drives the completed accumulation into buckle chute 160 so that the completed accumulation is folded about crease 24 between upper panel 12 and lower panel 20 of form 10. As the folded accumulation exits from assembly 140 it is captured by roller pair 178 and carried into trailing flap folder sealer assembly 180. There adhesive A is moistened by moistener 182, side flaps 16 are closed by closing mechanism 184 and tail flap 14 is closed, and all flaps are sealed by roller assembly 186. At this point form 10 and the accumulated sheets have been formed into a sealed mail piece. The sealed mail piece than is transported by transport 192 and exits folder sealer 6.

As sheets are driven in the nips of assemblies 106 and 140 with motors M1 and M2 not operating, any slight skew of the sheets with respect to the path of travel will be corrected as the leading edge of the sheets (or envelope form) are driven into the stationary nip. However if the skew of the sheets is too great the leading corner may bind in the nip preventing correction for the skew. To avoid this it may prove desirable to briefly operate motors M1 or M2 in a reverse direction to allow the leading edges of the sheets to align themselves parallel to the nips as they are driven against them.

As will be described below appropriate velocity profiles for motors M1 and M2 are readily achieved since motors M1 and M2 are stepper motors having readily controllable velocity profiles.

Figure 4:
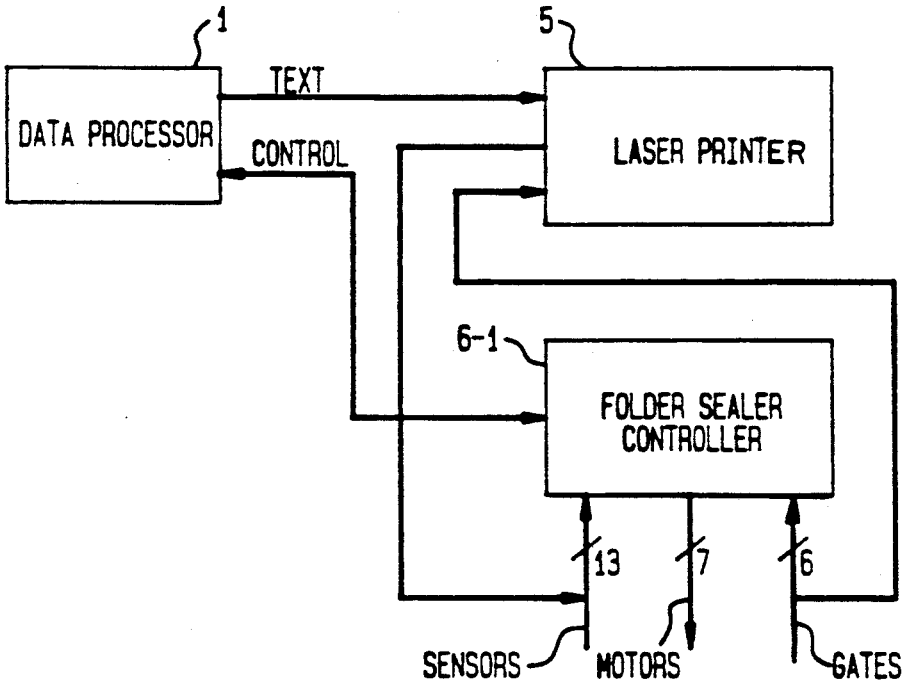
FIG. 4 shows a schematic block diagram of the flow of control and text information signals in accordance with the subject invention.
Figure 6:
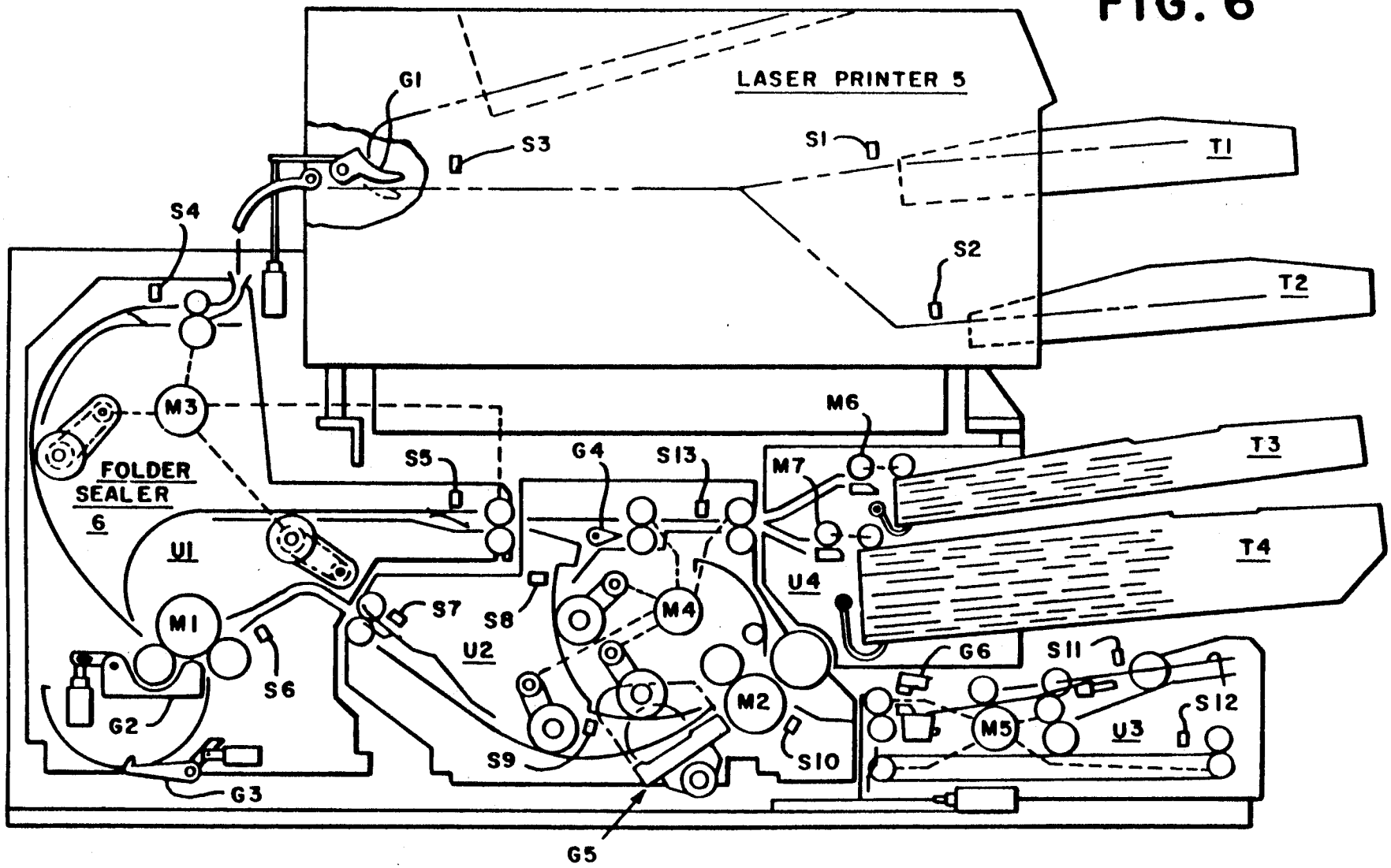
FIG. 6 shows the view of FIG. 1 showing the relationships of sensors, gates and motors which are controlled in accordance with the subject invention to produce mail pieces having a particular configuration.

Turning to FIG. 4 the control architecture for the system for the subject invention is shown. As described above data processor 1 controls laser printer 5 through a parallel interface in a conventional manner to print text. Folder sealer 6 is controlled through a conventional serial communications port, such as an RS232 port. Folder sealer 6 is controlled by controller 6-1, which includes an integrated circuit microcontroller, which is preferably a model 80C196KB manufactured by the Intel Corporation of Calif. As will be described below controller 6-1 receives data structures from data processor 1 defining the configuration for mail pieces in a given mail run, as well as specific information for each mail piece, such as ID numbers and variable numbers of printed sheets to be included in the mail piece. Controller 6-1 than controls sensors, motors, and gates in folder sealer 6 to produce mail pieces in accordance with the data structures and specific mail piece information. As can be seen in FIG. 6, minor modifications, easily within the skill in the art have been made to laser printer 5 to allow controller 6-1 to read sensors provided in laser printer 5 and control a gate which is also part of laser printer 5.

Figure 5:
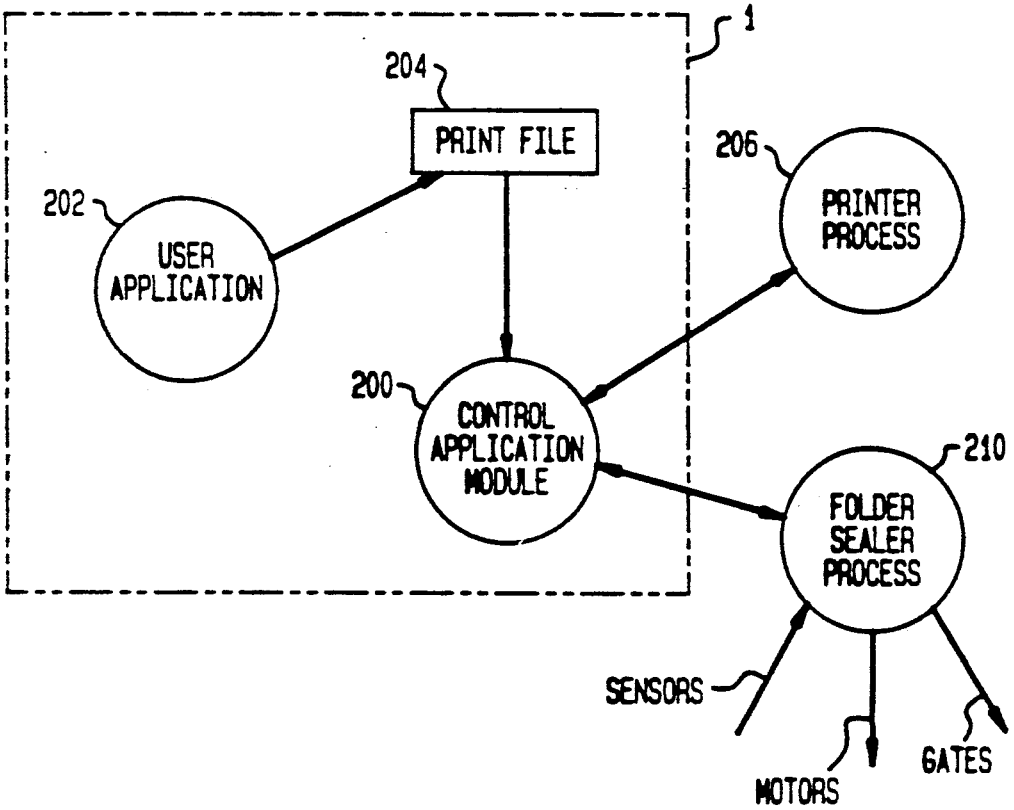
FIG. 5 shows a data flow diagram in accordance with the subject invention.

FIG. 5 shows the software architecture for the subject invention. In accordance with the subject invention data processor 1 runs a Control Application Module 200 to process documents produced by a conventional user application program 202 and output to a conventional print file 204. Control Application Module 200 includes a conventional printer driver to communicate with Printer Process 206 to print text from the documents in file 204 in a known, conventional; manner and a conventional, serial communications driver to communicate with folder sealer process 210 which runs in folder sealer controller 6-1. Module 200 also includes a Control Application Program which enables a user to define the mail piece configuration for a particular mail run. Data structures defining this configuration, as well as specific mail piece information are communicated to process 210 by the Communication Driver, and process 210 controls motors and gates in response to sensors to produce mail pieces comprising documents produced by the User Application 202 and having a configuration in accordance with the data structures and specific mail piece information; as will be described further below.

FIG. 6 is a schematic diagram of the sensors, motors and gates used in the prefer embodiment of the subject invention shown in FIG. 3. Sensors S1, S2 and S3 are part of commercially available laser printer 5. In the embodiment shown sensors S1 and S2 are provided by monitoring the feed signals to trays T1 and T2, though optical sensors to positively detect passage of sheets are, of course, within the contemplation of the subject invention. Sensor S3 is an optical sensor also provided in laser printer 5 which monitors output of sheet after printing. Gate G1 is a mechanical gate, also part of laser printer 5, which diverts sheets for output on top of laser printer 5, and as noted, has been modified so that it operates under control of controller 6-1. Sensor S4 is an optical censor provided in folder sealer 5 to detect passage of a printed sheet from laser printer 5 to folder sealer 6 along guides 100. Sensor S5 is an optical sensor which detects the presence of pre-printed sheets on guide 120 downstream of gate G4. Sensor S6 detects the presence of sheets output from accumulator folder assembly 106 on guide 130, and sensor S7 detects the presence of sheets accumulated in the nip of accumulator folder assembly 140. Sensors S8 and S9 detect the presence of two-thirds and one-third sheets, respectively, which have been diverted from guides 120 by gate G4 to accumulator folder assembly 140. Sensor S10 is an optical Sensor which detects the presence of a folded envelope form 10 and accumulated sheets output from assembly 140 and sensor S1 is an optical sensor which detects the presence of form 10 and the accumulated sheets in trailing flap folder sealer 180. Sensor S12 is an optical sensor which detects the output of a folded and sealed mail piece. Sensor S13 is an optical sensor which detects the presence of pre-printed sheet on guides 120 upstream from gate G4.

Gate G1, diverts sheets after printing for output at the top of laser printer 5 so that laser printer 5 may be used as a conventional computer output line printer without printed sheets passing through folder sealer 6, and also to facilitate recovery from jam and error conditions. When activated gate G2 diverts envelope form 10 and two-thirds length printed sheets through apparatus 106 without folding. When activated gate G3 effectively shortens the length of buckle chute 112 so that sheets accumulated for folding by apparatus 106 are ultimately folded in a "Z" fold, and when deactivated allows the full length of the accumulated sheets into buckled chute 112 so that these sheets are ultimately folded in a "C" fold. Gate G4 when activated diverts pre-printed two-thirds and one-thirds length sheets and BRE's from guides 120 to guides 144 for accumulation at accumulator folder assembly 140.

As will be described further below gates G5 and G6 are different from the other gates in that they do not change the path followed by sheets as they move through folder sealer 6. However, for control purposes they are handled as gates. Gate G5 is actually a pair of symmetrically movable lateral guides which are operated to assure that sheets accumulated with form 10 and apparatus 140 are laterally aligned with form 10. Gate G6 is part of moistener 182 which moistens adhesive A on form 10 as it enters trailing flap folder sealer 180.

Motors M1 and M2 operate accumulator folder assemblies 106 and 140 respectively. Motor M3 operates urge rollers 104 and 128, and roller pairs 102 and 126, and motor M4 operates urge rollers 153 and 155 and roller pairs 122, 124, and 132 (all shown in FIG. 3).

Motor M5 operates trailing flap folder sealer 180 and motors M6 and M7 feed pre-printed sheets from trays T3 and T4, respectively. Motors M1 through M7 are each operated individually under the direct control of controller 6-1.

Figure 7:
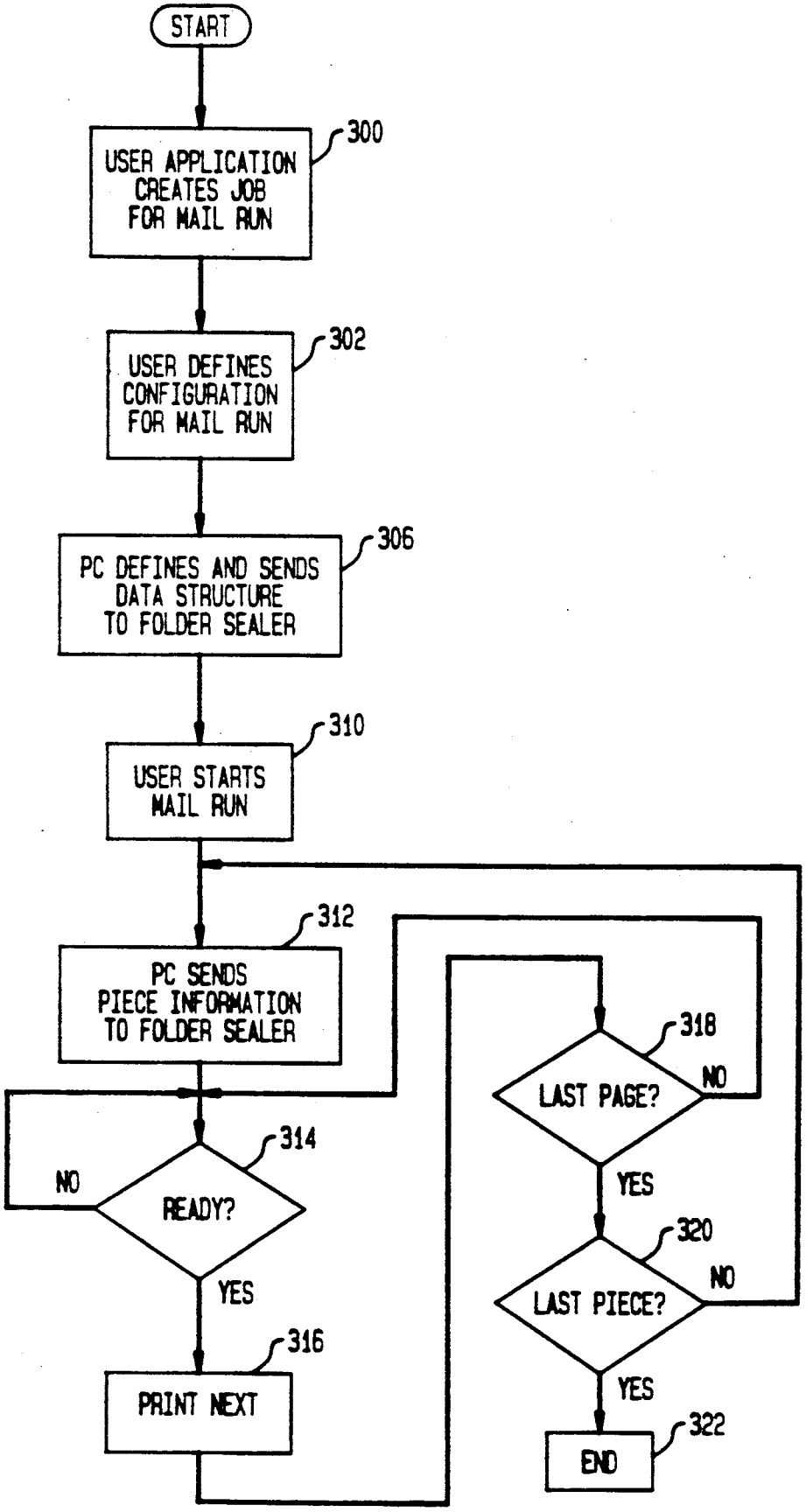
FIG. 7 shows a flow chart of the operation of the data processor of FIG. 1 in producing a mail run in accordance with the subject invention.

FIG. 7 shows a flow chart of the operation of the system of FIG. 1 in preparing a mail run. At 300 a user application, which may be any existing program which creates documents which are to be mailed, and outputs a JOB (i.e. a file of documents) to print file 204 in a conventional manner. Thus, in can be seen that the system of the subject invention interfaces with existing user application programs with minimal, if any, modification to those programs.

At 302 the Control Application Program in the Control Application Module interacts with a user who defines a configuration for the mail run by specifying the types of sheets in each of trays T1 through T4 and the number of sheets to be included from each tray in the mail piece, subject to the rules for allowable mail piece configurations specified above. Note that within these rules the number of printed pages to be included in a mail piece may vary from mail piece to mail piece within a given mail run. At this point the user may also identify an address block in the documents comprising the JOB and the Control Application Module will cause that address to be printed on a printed envelope form 10 and in selected address fields of printed sheets. Note that the Control Application Program checks to assure that occurrences of a particular address are contiguous. That is, a sheet or form 10 having a particular address may be followed by sheets having no address but a second address must not occur between two occurrences of the same address.

As will be described further below, at 306 the Control Application Program defines a data structure from the information supplied by the user defining the desired configuration for the mail run and sends this data structure to folder sealer controller 6-1. As will also be described further below controller 6-1 controls the sensors, motors, and gates described above in accordance with this data structure to produce mail pieces in the desired configuration.

Once the configuration is defined, at 310 the user initiates a mail run. At 312 the Control Application Program sends specific piece information to folder sealer controller 6-1. Preferably, this information includes date, piece ID, which is used in recovery from jam conditions so that if part of a mail piece is lost because of a paper jam the mail piece may be reprinted without loss of data, the number of pages to be printed, which may be variable within the limitations described above, and the type and ID of the device which initiates processing for each mail piece. If the specified configuration includes a printed envelope form 10 the folder sealer operation will begin when sensor S1 senses printed envelope form 10 being fed into laser printed 5. If the configuration specifies window envelope form 10 controller 6-1 will initiate operation by activating motor M6 to feed form 10 from tray T3. At 314 and 316 the Control Application Program will print the next printed sheet when folder sealer 6 is ready. If the first sheet is a printed envelope form 10 folder sealer 6 will be ready as soon as it is initialized and has responded to the piece information sent at 312 and the mail run will be initiated by the Control Application Program initiating printing of form 10 by laser printer 5; triggering sensor S1. If a non-window envelope form 10 is to be processed first controller 6-1 will initiate processing by activating motor M6 and the Control Application Program will respond to signals from controller 6-1 to initiate printing of sheets as required in accordance with the specified configuration. At 318 Control Application Program determines if the last printed sheet has been printed and if not returns to 314 to print the next sheet. If the last sheet has been printed at 320 the Control Application Program determines if this is the last mail piece and if not returns to 312 to begin printing of the next mail piece. When the last mail piece in a mail run has been processed the Control Application Program ends.

Figure 8A:
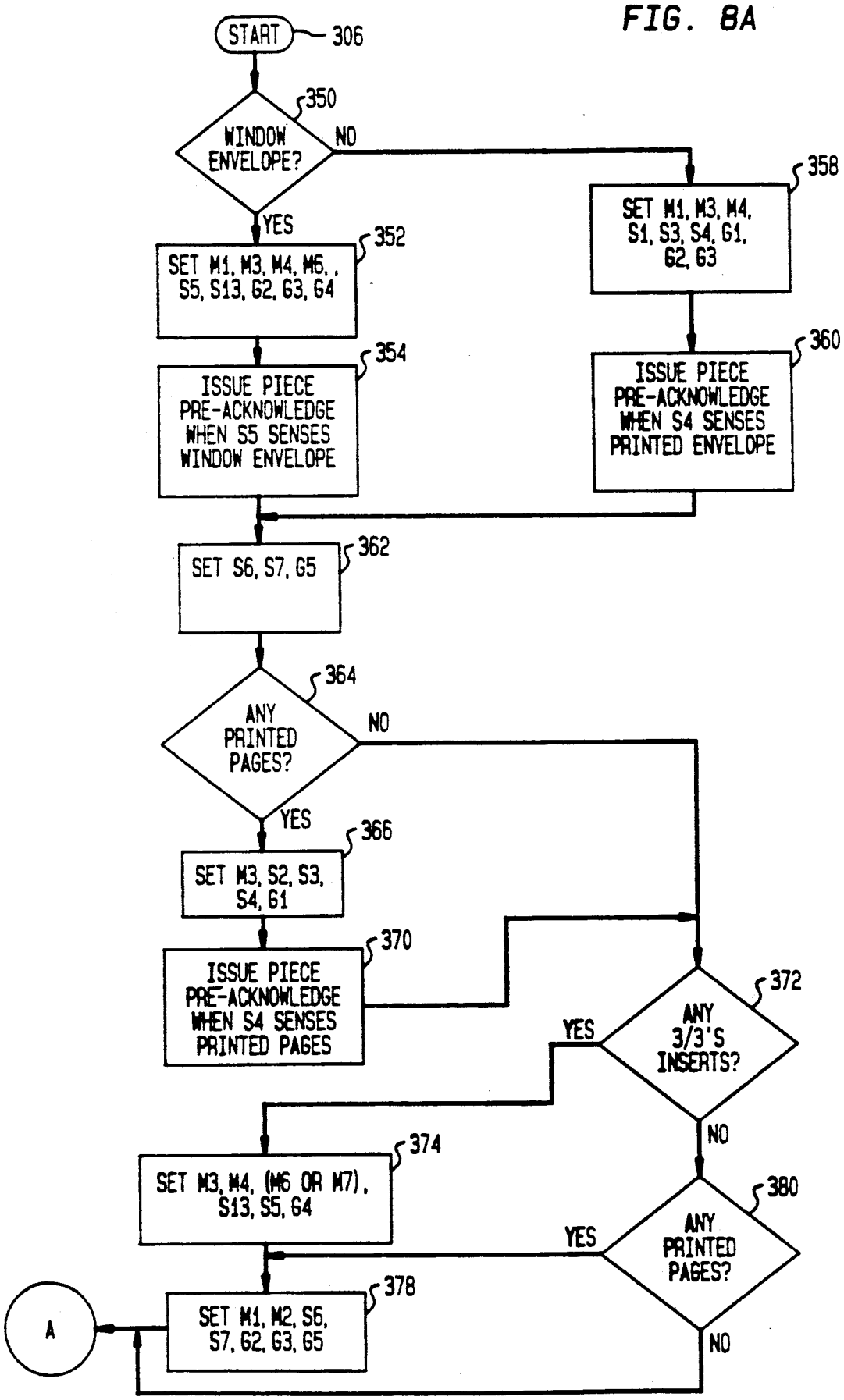
FIGS. 8A and 8B show a flow chart of the operation of the data processor of FIG. 1 in translating configuration information input by a user into a data structure for operation of the apparatus of FIG. 1.
Figure 8B:
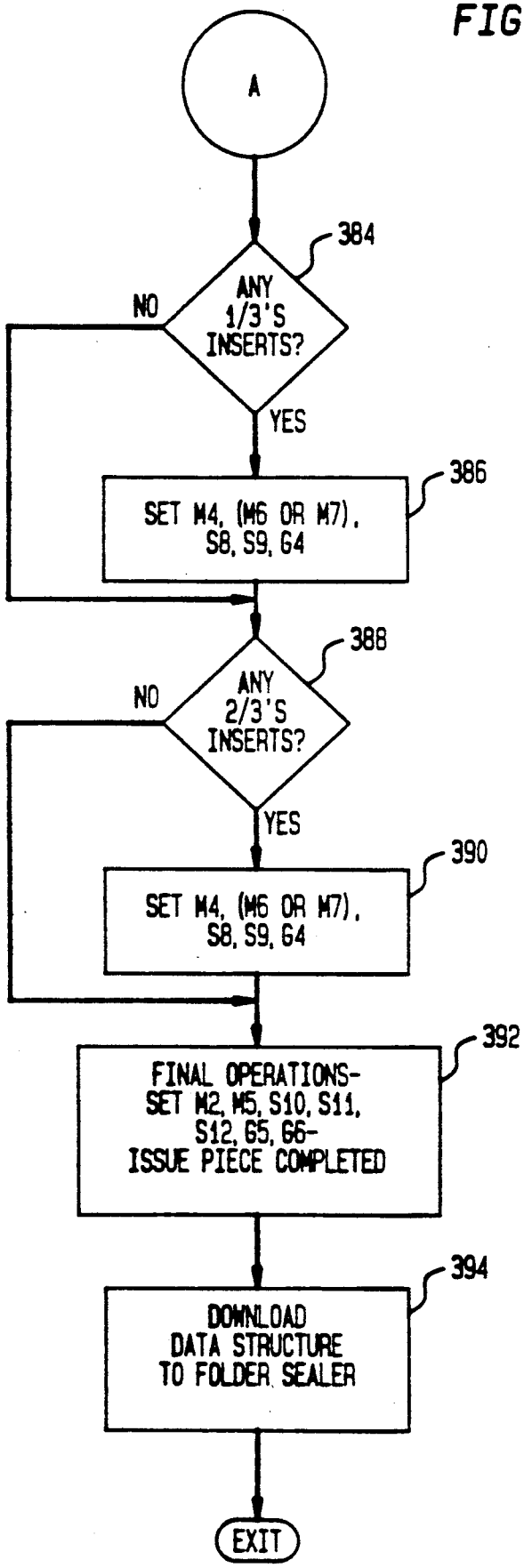

FIGS. 8A and 8B show a flow chart of the operation of the Control Application Program at 306 in developing a data structure corresponding to the mail piece configuration defined by the user at 302. At 350 the program determines if the user has specified a windowed envelope. If a windowed envelope is specified, at 352 the Control Application Program specifies that motor M6 will turn on to feed window envelope form 10 from tray T3, and that motors M3 and M4 will be turned on to transport form 10 in accumulator folder assembly 106. Gate G4 will be deactivated so that form 10 is not diverted from guide 120 onto to guides 144. Motor M1 is specified to start to transport form 10 through assembly 106 so that it is further transported by motors M3 and M4 into the nip of accumulator folder assembly 140. Gates G2 and G3 are specified so that form 10 is not folded, and sensors S5 and S13 are specified to monitor the flow of form 10 into assembly 106. AT 354 the data structure is specified so that Piece Pre-Acknowledge is issued when form 10 is sense by sensor S5.

If the user specifies a non-window, printed envelope, at 308 sensors S1, S3 and S4 are specified to monitor flow of form 10 from laser printer 5 into apparatus 106. Motors M1, M3 and M4 are started to transport form 10 through assembly 106 to the nip of assembly 140. At 360 the data structure is specified so that a Piece Pre-Acknowledge is issued when sensor S4 senses form 10.

In either event, at 362 the data is specified so that sensors S6 and S7 monitor the flow from assembly 106 to 140, and gate G5 is activated to align form 10 (either window or printed).

This completes the data structure specifying operations on envelope form 10. Then, at 364 the Control Application Program determines if the user has specified any printed pages. If there are printed pages, at 366 motor M3 is specified to start to feed sheets from tray T2, and sensors S2, S3 and S4 are set to monitor the flow of the sheet from tray T2 to accumulator folder apparatus 106. Gate G1 is specified to be deactivated so that the sheet will pass out of laser printer 5 into folder sealer six. At 370 the data is specified so that Piece Pre-Acknowledge issues when sensor S4 senses the sheet. Then, or if no printed pages were found at 364, at 372 the program tests to determine if any three-thirds pre-printed inserts have been specified by the user. If three-thirds inserts are specified at 374 motor, M6 (or M7) will be specified to start to feed pre-printed sheets from trays T3 (or T4), and motors M3 and M4 will be started to transport the pre-printed sheets along guides 120 into the nip of accumulator folder assembly 106, where they will be accumulated with any printed sheets. Sensors S5 and S13 are set to monitor the flow of the pre-printed inserts into the nip of assembly 106, and gate G4 will be deactivated. Than, at 378, the data is specified so that motor M1 will be started to fold the printed and/or pre-printed sheets which have been accumulated. Gate G2 is deactivated so that the accumulated sheets will enter buckle chute 112 and gate G3 will be activated or deactivated depending upon whether a "C" or "Z" fold is specified. Sensors S6 and S7 monitor the flow of the folded accumulation of three-thirds sheets and gate G5 will be activated to laterally align the accumulated sheets with form 10 in the nip of assembly 140.

Returning to 372, if there are no three-thirds pre-printed inserts at 380 the program again determines if there were any printed pages, and if there were again goes to 378 to specify motors M1 and M2, sensors S6 and S7, and gates G2 and G3 and G5 as described above. If there were neither any three-thirds pre-printed inserts or printed pages, or after 378 if there were, the data specification for three-thirds pages is completed and the Control Application Program goes to 384 in FIG. 8B.

At 384 the program determines if any one-third pre-printed inserts or BRE's had been specified by the user. If any have, then at 386 the data is specified so that motor M7 (or M6) will be started to feed from tray T4 (or T3), and gate G4 is activated so that the insert or BRE is transported along guides 144 into the nip of the assembly 140. Motor M4 will be started to transport the insert or BRE. Sensors S8 and S9 will be specified to monitor the flow of the insert or BRE.

Whether or not there are any one-third inserts at 388 the program will determine if there are any two-thirds inserts. If there are at 390 motors M4 and M6 or M7, sensors S8 and S9, and gate G4 will be specified as at 386.

This will complete provision of all the necessary parts of the configurations specified by the user, which will be accumulated at the nip of assembly 140. At 392 the final operations common to all mail pieces are carried out. Motor M2 will be specified to start to make the final fold in the mail piece, and motor M5 will be specified to start to activate trailing flap folder sealer 180 to fold the side and trailing flaps and finally seal the mail piece. Sensors S10, S11 and S12 are specified to monitor the flow of the mail piece, and gate G6 will be activated to moisten adhesive A on form 10. A Piece Completed is issued when the completed mail piece is sensed by sensor S12.

Once the data structure is completed for the particular configuration specified by the user the completed data structure is downloaded to folder sealer 6 at 394.

The data structure developed by data processor 1, as described above, consists of from 1 to 4 data elements, for each device active in processing a particular configuration, each data element including control parameters for specifying an operation to be performed by one of the sensors, motors, or gates shown in FIG. 6. Each data element is identified by an initial operation index value (or OP STATE) and includes a default initial state; that is the state the device will first enter when it is enabled unless another state is specified. The data element also specifies other devices and routines which are controlled by the particular device associated with each data element. The data element specifies which devices may be enabled or disabled and under what conditions during the operation of the particular device the other devices will be enabled or disabled. Each data element may also specify an alternative initial state for another device to be enabled. Each data element will also specify the next operation index value to indicate the next operation to be performed. If the corresponding device performs more than one operation; that is associated with more than one data element, an EXECUTE NEXT control byte is included in the associated data element indicating whether the next operation will be initiated immediately or the device will complete the first operation and return to an Idle State.

The set of data elements comprising the data structure which specifies the configuration selected by the user is executed by controller 6-1 to control the process of forming a mail piece. Controller 6-1 sequentially executes an Idle State to test each of the sensors, gates, or motors to determine if that device is enabled and for each such enabled device executes a state routine which correspond to the current state and current operation index value for that enable device. Devices which are not enabled remain in Idle State.

Figure 9:
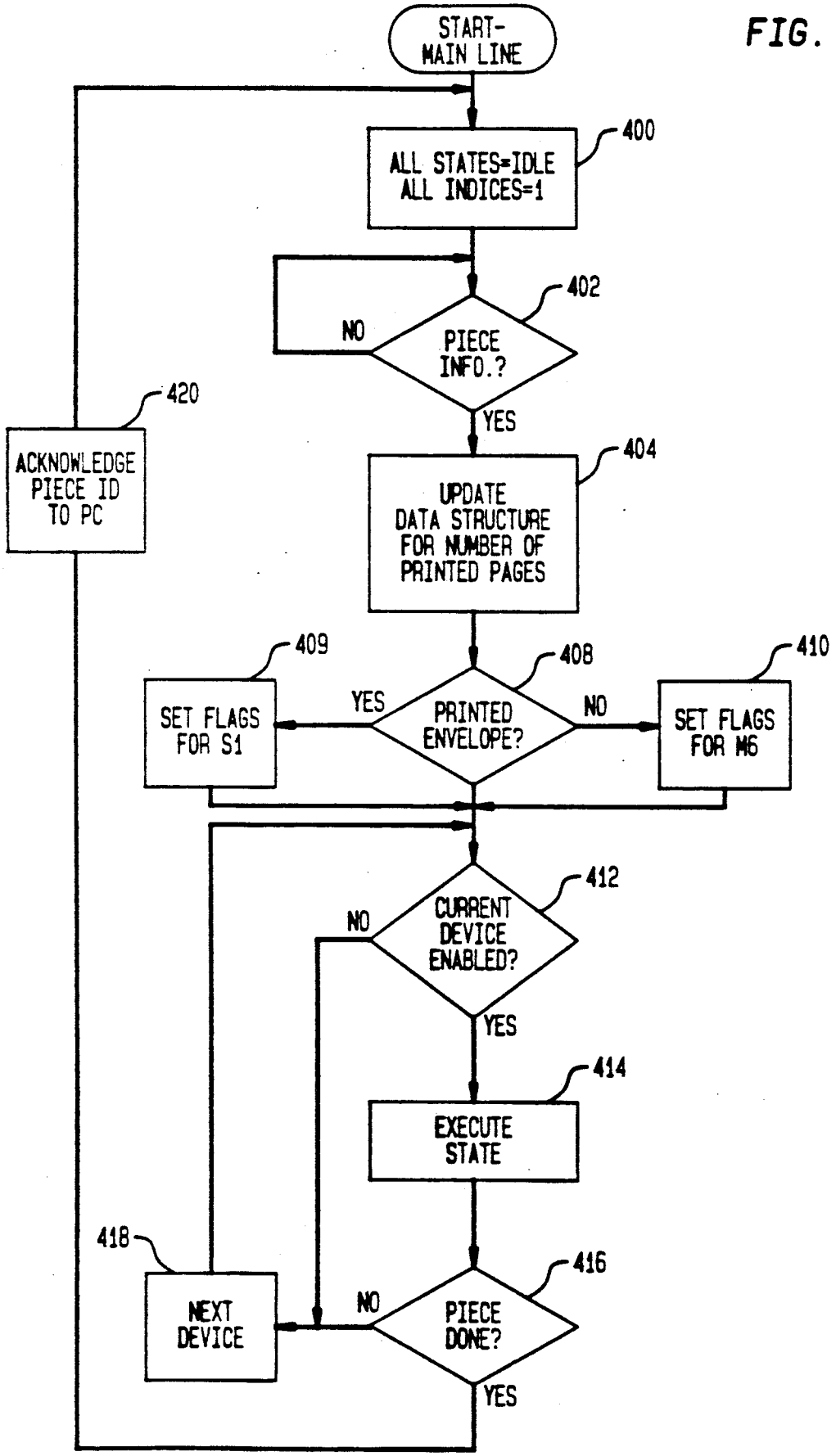
FIG. 9 shows a flow chart of the operation of the controller of FIG. 4 in controlling the devices of FIG. 6 to produce a mail piece.

FIG. 9 shows a flow chart of the mainline routine which tests each device in folder sealer 6; and sensors S1, S2 and S3, and gate G1 in laser printer 5; which as noted, operate under control of controller 6-1. After the data structure has been downloaded and controller 6-1 has responded to data processor 1, at 400 all devices are in an Idle State and all operation index values are set equal to 1. At 402 controller 6-1 waits for initial piece information from data processor 1. This piece information includes a mail piece identification number, which may be used in recovering from a paper jam or other error condition, the number of printed pages included in a particular mail piece, which as noted above may be variable, and the identification of the particular device which will initiate operation on that mail piece. That is, depending upon whether the mail piece has a printed envelope or a window envelope, operations on the mail piece will commence either when sensor S1 detects a non-window form 10 being fed from tray T1 as data processor 1 initiates printing, or controller 6-1 will energize motor M6 to feed a window envelope form 10 from tray T3. When the piece information is received, at 404 the data structure is updated for the number of printed pages, as will be described further below. It should be noted that only the number of printed pages is allowed to vary, and that in the preferred embodiment described those data elements related to assembling pre-printed sheets and BRE's are fixed in each configuration for a mail run. At 408, depending upon whether the mail piece includes a printed envelope form 10 or a window envelope 10, the program will either set flags to enable sensor S1 at 408 or set flags to enable motor M6 at 410. In either case, at 412 the mainline routine will be to sequentially execute the Idle State for each device to test the devices to identify those which are enabled. If the device currently tested is enabled at 414 the device state routine corresponding to the present operational index and state for that device is executed. At 416 the routine determines if the mail piece has been completed and if it has not, at 418 indexes to the next device and returns to 412. If the mail piece has been completed controller 6-1 acknowledges completion by transmitting the piece identification to data processor 1, at 420, and returns to 402. The mainline routine will remain in a loop until the mail run is complete and the system is reset.

Alternatively to downloading a new configuration for each mail run a JOB created on the user's application program may be output as a mail run using a previously stored configuration in a matter essentially identical to that described above.

Details of the state routines for the various devices used in the preferred embodiment are described in commonly assigned co-pending U.S. application Ser. No. 492,039, titled: *System and Methods for Controlling an Apparatus to Produce Items in Selected configurations,* filed on even date herewith, and are not believed necessary for an understanding of the subject invention.

In a preferred embodiment of the subject invention sensor S3, which as discussed above forms part of laser printer 5 and is modified to be monitored by controller 6-1, operates in accordance with the data structure to call Check Excess Pages. This routine is specified in data elements as though it were an other device, however, when sensor S3 detects a sheet and activates Check Excess Pages controller 6-1 does not execute any state routines associated with any devices. Instead the routine controls gate G1, which is also a part of commercially available printer 5, modified to operate under control of controller 6-1, to divert sheets to exit along path at the top of printer 5 when data processor 1 specifies a mail piece configuration which has greater than the allowed maximum number of pages for folder-sealer 6. In this manner printed sheets for mail pieces which might otherwise jam in folder sealer 6 are diverted for separate manual processing without loss of information.

Figure 10:
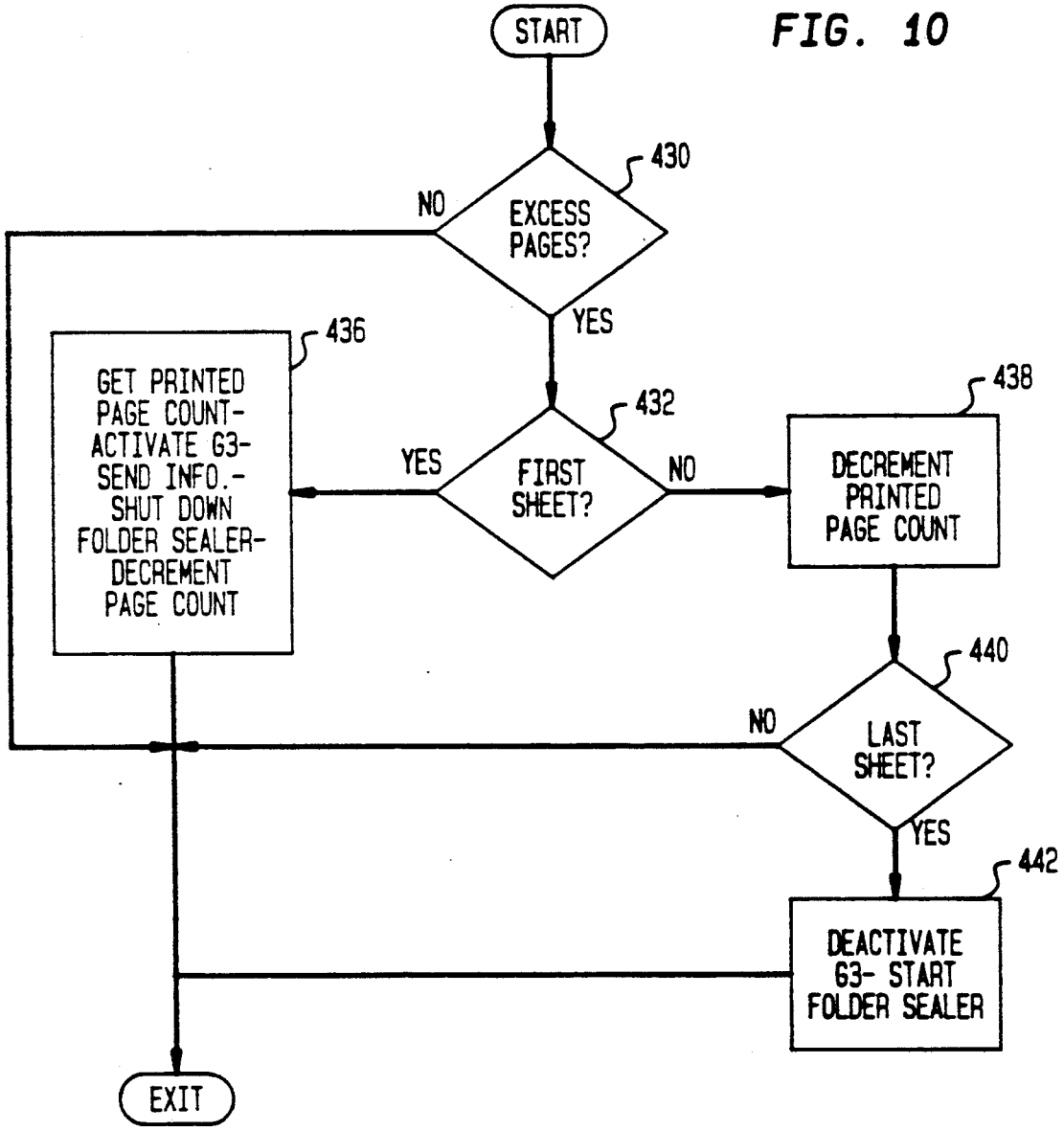
FIG. 10 shows a flow chart of a routine in accordance with the subject invention which is called by one of the devices of FIG. 6 to determine if the number of pages to be folded to form the mail piece exceeds a predetermined maximum and if so to abort production of the mail piece.

In FIG. 10 a flow chart of the Check Excess Pages routine is shown. When sensor S3 detects a sheet Check Excess Pages is called, and at 430 determines if the number of three thirds or two thirds size sheets specified in he data structure (and piece information if a variable number of printed sheets is specified) exceeds the permitted maximum; three in the preferred embodiment shown. If the number does not exceed the maximum the routine exits. If it does then at 432 the routine determines if this is the first printed sheet. If it is then at 436 the routine determines the number of printed sheets in the mail piece as defined in the data structure or in the piece information, sends a signal to data processor 1 identifying the mail piece which will not be processed, shuts down folder sealer 6, activates G3, and decrements the printed page count, then exits. If, at 432, the routine determines it is not the first printed sheet then, at 438, the printed page count is decremented. At 440 the routine determines if this is the last sheet and, if it is not, exits. If it is (i.e. the printed page count is zero) gate G3 is deactivated and folder sealer 6 is restarted.

It is also within the contemplation of the subject invention to test other characteristics of the mail piece configuration such as the total thickness of the mail piece (i.e. total number of sheets), and to divert printed sheets when the mail piece does not meet standards.

What is claimed is:

1. Apparatus for preparing a mail piece, comprising:

a) input means for input of information defining a mail piece configuration;

b) a printer for printing text on at least a sheet and an address on an associated envelope form;

c) sheet processing means for receiving at least said sheet and said envelope form from said printer and for accumulating at least said sheet and said envelope form, folding said accumulated sheet and envelope form and then sealing said envelope form to form said mail pieces, said sheet processing means having a capacity to process mail pieces having a predetermined maximum value of a parameter, said parameter defining the number of sheets in said mail pieces;

d) diverting means for selectively diverting sheets and envelope forms output by said printer from input to said sheet processing means; and e) control means responsive to said input means for:

e1) determining the value of said parameter in accordance with said defining information; and, e2) if the value of said parameter is less than said maximum value, controlling said sheet.

2. Apparatus as described in claim 1 wherein:

a) said sheet processing means performs a sequence operations to form said mail piece;

b) said control systems translates said defining information into a data structure comprising a plurality of data elements, each of said data elements specifying control parameters for an operation in said sequence; and c) one of said data elements further includes a control parameter for causing said control system to execute a predetermined routine to determine the value of said parameter in said mail piece, and, if the value of said parameter is greater than or equal to said maximum value, divert at least said sheet and said envelope form from said processing means.

3. Apparatus as described in claim 2 wherein said control system comprises:

a) a data processing system for translating said defining information and generating and outputting said data structure; and b) controller means responsive to said data processing means for controlling said sheet processing means.

4. A method of preparing a mail piece, comprising the steps of:

a) receiving at least a sheet and an envelope form;

b) receiving information, including the value of a parameter, defining a mail piece configuration, said parameter defining the number of sheets in said mail piece;

c) printing at least said sheet with text and said envelope form with an address; and d) if the value of said parameter is less than a predetermined maximum, accumulating at least said sheet and said envelope form, folding said accumulated sheet and envelope form, and sealing said envelope form to form a mail piece in accordance with said defining information; and otherwise, e) diverting at least said sheet and said envelope form for output after said printing step and without further processing.

5. A method as described in claim 4 wherein said processing step includes performing a sequence of operations in accordance with a data structure, said data structure corresponding to said defining information and comprising a plurality of data elements, each of said data elements specifying control parameters for one of said operations; wherein one of said data elements specifies a first control parameter for printing said sheets and further includes a second control parameter for initiating said determining step.

* * * * *